US005584076A

United States Patent [19]

Armstrong

[11] Patent Number: 5,584,076

[45] Date of Patent: Dec. 17, 1996

[54] ADJUSTABLE CAP HAVING A FULLY REMOVABLE ADJUSTMENT STRAP

[76] Inventor: James A. Armstrong, 8415 Mayfair, Cincinnati, Ohio 45216

[21] Appl. No.: 203,270

[22] Filed: Feb. 28, 1994

[51] Int. Cl.[6] ..... A42B 1/22

[52] U.S. Cl. ..... 2/195.2; 2/181.4; 2/183; 2/209.13

[58] Field of Search ..... 2/171.1, 181, 181.2, 2/181.4, 183, 195.2, 195.3, 195.4, 417, 418, 420, DIG. 11, 209.13, 175.3, 918; 24/306, 442; D2/874, 877, 880, 881, 884, 891, 894; 40/329

[56] References Cited

U.S. PATENT DOCUMENTS

| | | | |
|---|---|---|---|
| D. 52,905 | 1/1919 | Baehr | D2/894 |
| 1,333,708 | 3/1920 | Fischer . | |
| 1,435,221 | 11/1922 | Fischer . | |
| 1,461,623 | 7/1923 | Lebow . | |
| 1,494,929 | 5/1924 | Ostrove . | |
| 1,501,654 | 7/1924 | Fischer . | |
| 1,516,284 | 11/1924 | Schneider et al. . | |
| 1,542,302 | 6/1925 | Kaplan . | |
| 1,702,427 | 2/1929 | Blum . | |
| 1,725,425 | 8/1929 | Steingold . | |
| 1,808,966 | 6/1931 | Morgan . | |
| 2,010,107 | 8/1935 | Probst . | |
| 2,181,446 | 11/1939 | Ames . | |
| 2,194,043 | 3/1940 | Jacobi . | |
| 4,023,212 | 5/1977 | Huffman . | |
| 4,630,317 | 12/1986 | Brown et al . | |
| 4,776,043 | 10/1988 | Coleman . | |
| 4,815,148 | 3/1989 | Satterfield . | |
| 4,845,782 | 7/1989 | Gregg . | |
| 4,864,662 | 9/1989 | Frank . | |
| 4,872,218 | 10/1989 | Holt . | |
| 4,873,726 | 10/1989 | Tapia . | |
| 4,910,806 | 3/1990 | Baker et al. . | |
| 4,918,758 | 4/1990 | Rendina . | |
| 5,003,640 | 4/1991 | Pizzacar | 2/195.2 |
| 5,025,504 | 6/1991 | Benston et al. . | |
| 5,099,524 | 3/1992 | Linday . | |
| 5,384,916 | 1/1995 | Portney | 2/195.2 |
| 5,402,538 | 4/1995 | Conrad | 2/195.2 |

FOREIGN PATENT DOCUMENTS

| | | |
|---|---|---|
| 1259571 | 3/1961 | France . |
| 1113788 | 5/1968 | United Kingdom . |

OTHER PUBLICATIONS

Cherokee Cap Company advertising sheet bearing no date and referring to "Logo Strap" alleged to be (Patent Pending).

*Primary Examiner*—Diana Biefeld
*Attorney, Agent, or Firm*—Wood, Herron & Evans, P.L.L.

[57] ABSTRACT

An adjustable cap has a fully removable adjustment strap that may be releasably secured to both sides of the gap in the back of a cap for accommodating any size user. The adjustment strap includes at least one graphic display that is centerable across the gap in the back side of the cap.

5 Claims, 2 Drawing Sheets

ADJUSTABLE CAP HAVING A FULLY REMOVABLE ADJUSTMENT STRAP

FIELD OF THE INVENTION

The present invention relates generally to adjustable caps and more specifically to an adjustable cap having a fully removable adjustment strap that includes a graphic display.

BACKGROUND OF THE INVENTION

Adjustable caps that may be sized to fit any individual have been available for a number of years. Typically, these caps use one of two methods for adjusting the size of the cap. First, they may use an elastic band contained within the largest diameter portion of the cap that can accommodate any size head. Alternatively, the cap includes a gap in the back of the head covering portion the size of which may be adjusted depending upon the head size of the individual. With these caps, a pair of straps is affixed to both sides of the gap for adjusting the size thereof. Alternate structures on the straps for adjusting the size of the gap include a belt-buckle type arrangement, mating holes and projections or cloth fastening tape hook and loop material such as that sold under the trademark "VELCRO". However, existing adjustable caps suffer from many problems.

First, to accommodate an elastic band, the cloth material of the cap must be of sufficient size to fit the largest wearer contemplated resulting in the material folding or puckering when worn by people having a smaller head. This causes the cap to have an unsightly appearance. Further, the elastic band may fit too snugly on the head of the user, making the cap uncomfortable to wear. Still further, the interlocking straps traditionally used on adjustable caps having a gap in the back generally present an unsightly outward appearance. This is particularly true when the cap is worn in a reverse manner, such that the bill of the cap is towards the rear of the head of the user and the back of the cap is located on or over the forehead of the user, as is popular among younger wearers.

Existing adjustable caps are generally unable to accommodate text or graphic displays along the rear of the cap. With caps having an elastic band, the cap fabric is distorted by the elastic band. 0n caps using adjustment straps, any text placed on the adjustment straps would not likely be centered as the exposed portions of the straps changes with each wearer. One prior attempt shown in Pizzacar U.S. Pat. No. 5,003,640 uses a nameplate having text thereon that is removably mounted to the adjustment straps and partially hides the adjustment straps thereunder. Although enabling the wearer to affix text to the back of the cap, the system requires additional components and only partially hides the adjustment straps.

Therefore, there is a significant need for an adjustable cap having a tailored outer appearance regardless of the size of the user. Further, it would be beneficial for the cap to be able to accommodate graphic displays that are centerable across the back side of the cap.

SUMMARY OF THE INVENTION

The present invention provides an adjustable cap having a tailored, fit-to-size outer appearance that may accommodate centerable graphic displays along the back side of the cap. To this end, and in accordance with the principles of the present invention, an adjustable cap similar to a standard baseball cap is provided comprising a flexible head covering portion having a bill, a back side and a lower rim, the back side and rim having a gap formed therein for use in adjusting the size of the head covering portion; a fully removable adjustment strap whose ends are adapted to be releasably secured to opposing sides of the gap in the back of the hat, and with the head covering portion being adapted to receive the ends of the adjustment strap such that they are hidden from view when the hat is being worn, thereby giving the adjustable cap a tailored, fit-to-size appearance.

It is further contemplated that at least one graphic display will be included on the adjustment strap. The graphic display is centerable across the gap in the hat by adjusting the position of both ends of the adjustment strap within the head covering portion of the hat as will be discussed below. Preferably, the adjustment strap is of a sufficient length to include a plurality of graphic displays such that any one of the displays is viewable at a time and centerable across the back side of the hat by adjusting the position of both ends of the adjustment strap within the head covering portion.

Preferably the head covering portion includes a sweat band comprising a cloth portion affixed to the lower rim of the cap that extends from one side of the gap, behind the bill, and to the other side of the gap. The sweat band is folded into the head covering portion to form a channel along the inside surface of the hat that is sized to receive and guide the adjustment strap. The top edge of the sweat band may be tacked near the gap to secure the sweat band to the inside surface of the cap, or alternatively, the sweat band may be unsecured along the top edge such that the sweat band is freely foldable into and out of the head covering portion.

If the sweat band is tacked to the inside surface of the hat, access to the channel is provided by a pair of vertically disposed slits formed in the head covering portion near or adjacent both sides of the gap. The slits are sized to permit the passage of the adjustment strap therethrough. To releasably secure the adjustment strap to the head covering portion, it is contemplated that cloth fastening tape, such as that sold under the trademark "VELCRO", will be used. One advantage of using this type of cloth fastening tape is the ability to adjust the hat to any size within the hat's dimensional limits, Also, the resulting adjustment strap displays a smooth appearance and requires no hard-surface securing points on the hat which could be uncomfortable for the wearer.

Preferably, cloth fastening tape hook material is secured to the outside surface of the head covering portion, between the gap and the slits, and cloth fastening tape hook material is secured to the inner surface of the adjustment strap, Alternatively, the cloth fastening tape hook material may be placed along the channel surface of the sweat band near the slits.

If the sweat band is freely foldable into and out of the head covering portion, access to the channel is provided along the sides of the gap where the sweat band, head covering portion, and sides of the gap meet. To releasably secure the adjustment strap to the head covering portion, it is contemplated that the channel surface of the sweat band may have cloth fastening tape hook material secured thereto near the gap, with the inside surface of the adjustment strap having cloth fastening tape loop material secured thereto such that the sweat band releasably locks the adjustment strap into position when the sweat band is folded into the head covering portion to form the channel.

Although it is contemplated that the cloth fastening tape hook material will be secured to the head covering portion or sweat band portion and the cloth fastening tape loop material will be secured to the adjustment strap, these could be reversed. Additionally, other fastening methods, such as buckles or snaps, may be used.

By virtue of the foregoing, there is thus provided an adjustable cap having a tailored, fit-to-size outer appearance that may include graphic displays that are centerable across the back side of the hat. These and other objects and advantages of the present invention shall be apparent from the accompanying drawings and the descriptions thereof.

BRIEF DESCRIPTION OF THE DRAWINGS

The accompanying drawings, which are incorporated in and constitute a part of this specification, illustrate embodiments of the invention and, together with a detailed description of the invention given below, serve to explain the principles of the present invention.

DETAILED DESCRIPTION OF THE INVENTION

Figure 1:
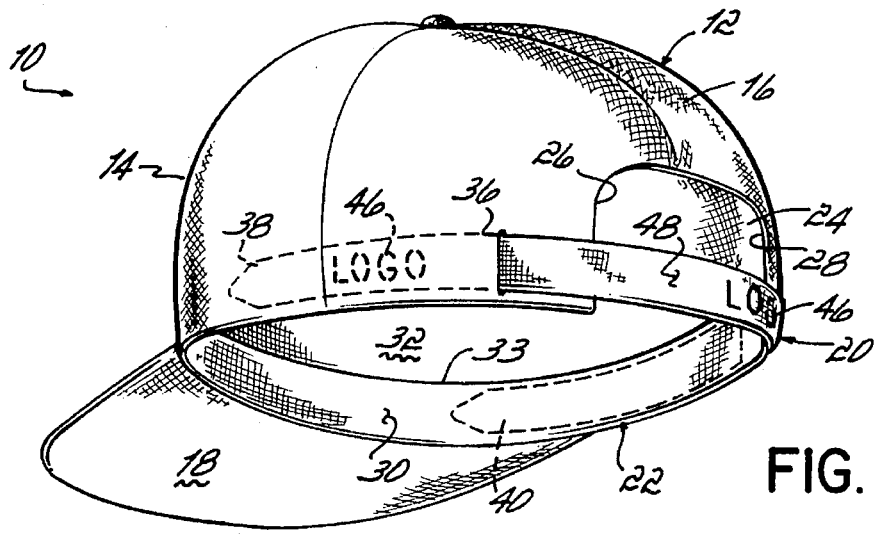
FIG. 1 is a rear perspective view of an adjustable cap in accordance with the principles of the present invention.
Figure 2:
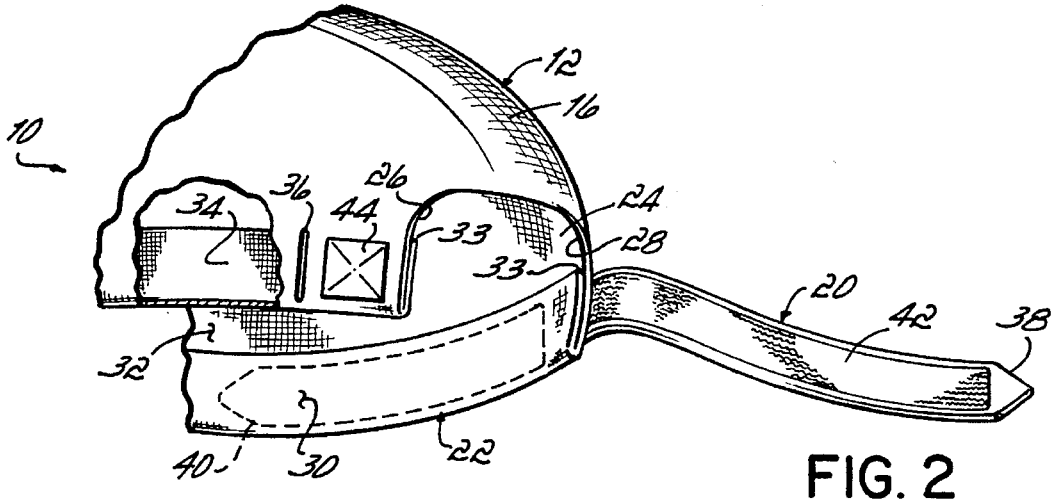
FIG. 2 is a partial rear perspective view of the adjustable cap of FIG. 1 with one side of the adjustment strap being unsecured to the head covering portion.

With reference to FIGS. 1 and 2, there is shown an adjustable cap 10, similar to a baseball cap, comprising a flexible head covering portion 12 having a front side 14 and a back side 16, a conventional visor 18 extending from front side 14 and an adjustment strap 20 adapted to be releasably securable to back side 16 of head covering portion 12 for use in adjusting the size thereof.

Head covering portion 12 includes a substantially circular lower rim 22. Further, lower rim 22 and back side 16 include a gap 24 formed by a first side 26 and a second side 28 symmetrically positioned on either side of the center of the back side 16. Gap 24, which may be substantially semicircular or rectangular in shape, is for use in permitting the size of head covering portion 12 to be adjusted to fit any size wearer. A cloth sweatband 30 having substantially the same length as lower rim 22 is affixed by sewing or other accepted technique. For purposes of this invention, the term sweatband encompasses any cloth strap that folds upwardly into the cap to serve as a liner between the head covering portion 12 and the head of the wearer. However, additional absorbent pads or straps may be secured to the head covering portion 12 to absorb moisture without deviating from the scope or spirit of the present invention. Sweatband 30 is folded upwardly into the inside surface 32 of head covering portion 12, with the top corner edges 33 of sweatband 30 being sewn or tacked to head opening portion 12. Together, sweat band 30 and head covering portion 12 form a channel 34 for a use to be described below. Head covering portion 12 further includes a pair of substantially vertically oriented slits 36 disposed on either side of gap 24 and spaced slightly therefrom that are in communication with channel 34. Alternatively, the slits 36 may be disposed at an angle relative to vertical for manufacturing or aesthetic purposes.

Adjustment strap 20 has a first end 38 and a second end 40 and is sized to be received within slits 36 and channel 34 such that strap first and second ends 38, 40 are hidden from view in use. To releasably secure adjustment strap 20 to head covering portion 12, the inside surface of adjustment strap 20 has cloth fastening tape loop material 42 secured thereto. Mating cloth fastening tape hook material 44 is affixed to the outside of the head covering portion 12 between slits 36 and the first and second sides 26, 28 of gap 24. Thus, adjustment strap first and second ends 38, 40 are inserted into slits 36 to the desired length and adjustment strap 20 is pressed against head covering portion 12 such that the cloth fastening tape loop material 42 on adjustment strap 20 is secured to the cloth fastening tape hook material 44. Either end of adjustment strap 20 may be adjusted by separating the cloth fastening tape material and slidably moving that portion of adjustment strap 20 into or out of channel 34.

Preferably, the cloth fastening tape hook and loop material is that sold under the trademark "VELCRO". However, other fastening means may be used to releasably secure adjustment strap 20 to head covering portion 12, including buckles secured to head covering portion 12, mating snaps and holes, and other accepted techniques. Further, the cloth fastening tape loop material may be affixed to the head covering portion 12 and the cloth fastening tape hook material may be affixed to the adjustment strap 20. However, the first arrangement is preferred as the cloth fastening tape loop material is generally soft to the touch and its placement on adjustment strap 20 will not irritate the head of the wearer. Additional variations will be readily apparent to those skilled in the art.

The length of adjustment strap 20 should at least be greater than the distance between first side 26 and second side 28 of gap 24 to permit the largest size wearer to be accommodated. However, the length should be less than the size of the head of the smallest contemplated wearer so the adjustment strap 20 does not overlap itself in use.

Preferably, adjustment strap 20 includes at least one graphic display 46, such as a logo, on the outside surface 48 thereof. Graphic display 46 is centerable across the gap 24 in the back side 16 of head covering portion 12 by positioning of the first and second ends 38, 40 of adjustment strap 20 within channel 34. Additionally, adjustment strap 20 may include a plurality of graphic displays 46 spaced along the outside surface 48 thereof such that any one of the graphic displays 46 is viewable at a time and centerable across gap 24 in the back side 16 of head covering portion 12 by adjusting adjustment strap 20 to the correct position relative to the slits 36 in the head covering portion 12. Placing graphic display 46 on the adjustment strap 20 has the advantage of being displayed at the front of the head when cap 10 is worn backwards, as many are doing, particularly younger wearers.

The adjustable cap 10 is preferably made from cotton, polyester, or any other flexible fabric using traditional manufacturing techniques for producing caps. Further, adjustment strap 20 may be made from plastic, but cloth is preferred.

Figure 3:
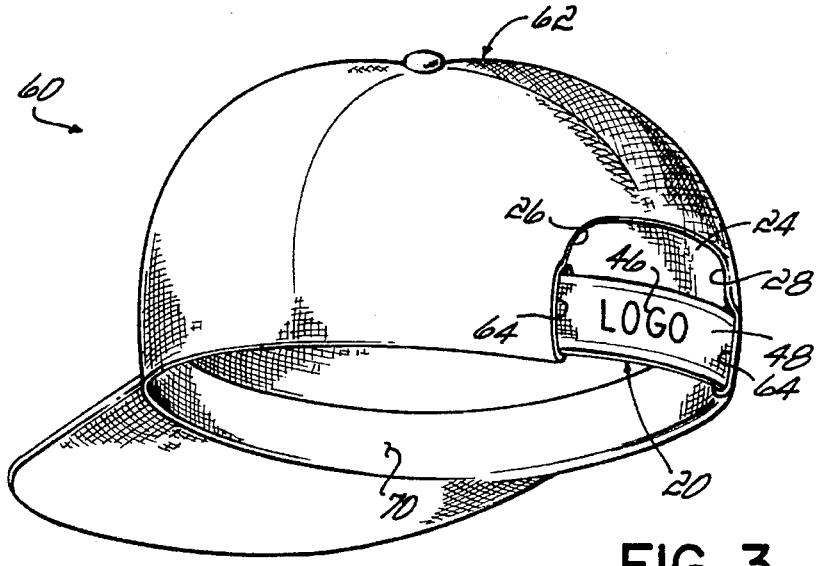
FIG. 3 is a rear perspective view of another adjustable cap in accordance with the principles of the present invention.
Figure 4:
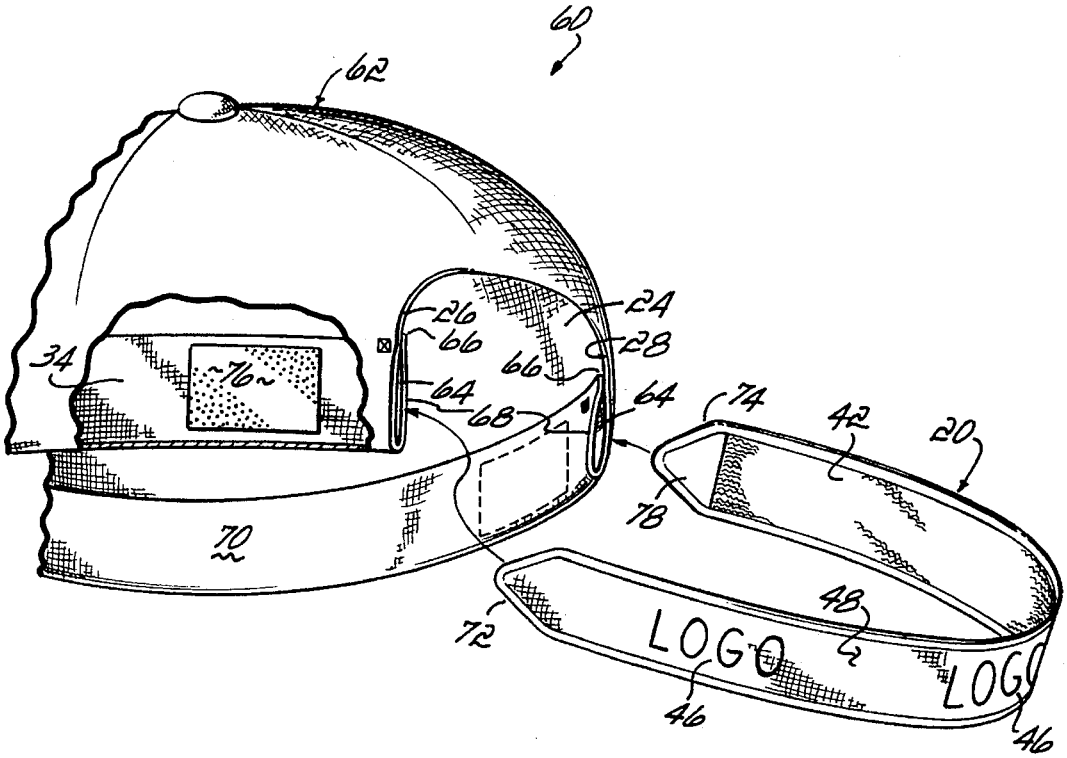
FIG. 4 is a rear perspective view, partially broken away, of the adjustable cap of FIG. 3 with the adjustment strap removed.

With reference to FIGS. 3 and 4, there is shown another adjustable cap 60 in accordance with the principles of the present invention similar to adjustable cap 10, with like parts having like numbers. However, the structure for releasably securing adjustable strap 20 to head covering portion 62 has been altered. Specifically, slits 64 are formed by sewing or tacking the top corner portions 66 of the edges 68 of sweatband 70 that are adjacent first side 26 and second side 28 of gap 24 to head covering portion 62 and leaving the remaining portion of edges 68 free. Adjustment strap 20 is then sized to be received within the slits 64 and channel 34 such that adjustment strap first and second ends 72, 74 are hidden from view in use.

As before, adjustment strap 20 preferably includes cloth fastening tape loop material 42 on the inside surface thereof. However, the cloth fastening tape hook material 76 is secured to the channel side of sweatband 70 near gap first and second sides 26, 28 rather than to the outer surface of the head covering portion 62, Additionally, to aid in adjusting the position of adjustment strap 20 within channel 34, the leading portion 78 of the first and second ends 72, 74 of adjustment strap 20 do not include cloth fastening tape loop material.

Figure 5:
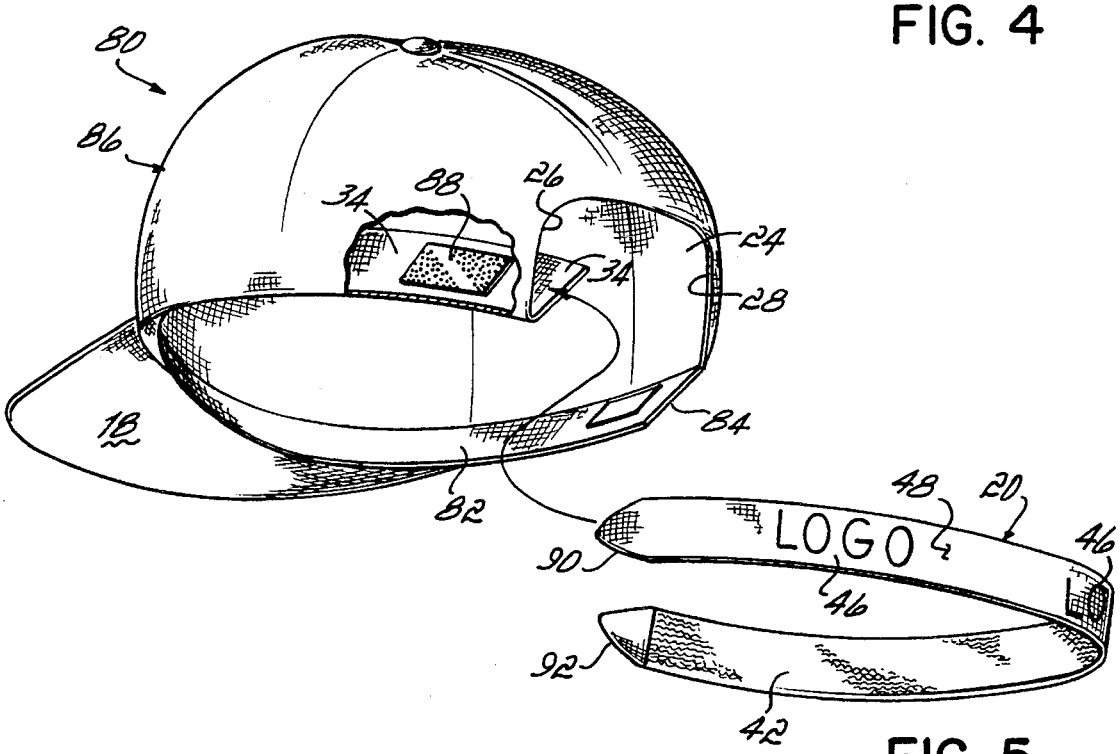
FIG. 5 is a rear perspective view of a still further adjustable cap in accordance with the principles of the present invention.

Referring to FIG. 5, there is shown yet another adjustable cap 80 in accordance with the principles of the present invention. Adjustable cap 80 is similar to adjustable cap 60, except that sweatband 82 is secured only along the lower rim 84 of head covering portion 86. Thus, sweatband 82 may be freely folded into and out of head covering portion 86 to form channel 34. As before, the channel side surface of sweatband 82 near the first and second sides 26, 28 of the gap 24 includes cloth fastening tape hook material 88 secured thereto, To secure adjustment strap 20 to the head covering portion 86, the user unfolds sweatband 82, positions adjustment strap 20 within head covering portion 86 and folds sweatband 82 upwards such that the cloth fastening tape hook material 88 is removably secured to the cloth fastening tape loop material 42 on adjustment strap 20. To remove adjustment strap 20, or adjust the relative size of head covering portion 86, sweatband 82 is again folded down, thereby releasing adjustment strap 20 therefrom. As with the other two embodiments, adjustment strap first and second ends 90, 92 are hidden from view during use in the channel 34.

By virtue of the foregoing, there is thus provided an adjustable cap having a tailored, fit-to-size outer appearance independent of the size of the user. Further, the adjustable cap is able to display a graphic symbol centered along the back side of the cap.

While the present invention has been illustrated by description of different embodiments which have been described at considerable detail, it is not the intention of the applicant to restrict or in any way limit the scope of the appended claims to such detail. Additional advantages will readily appear to those skilled in the art. For example, the cloth fastening tape loop and hook material used for releasably securing adjustment strap 20 to head covering portion 12, 62, 86 may be replaced by other devices such as a belt and loop structure or snaps which are contained within channels 34. Further, the cap may include a logo display above the visor 18 along the head covering portion 12, 62, 86. Thus, the invention in its broadest aspects is not limited to the specific details, representative apparatus and method, and illustrative examples shown and described. Accordingly, departures may be made from the details without departing from the sphere or scope of applicant's general inventive concept.

What is claimed is:

1. An adjustable cap comprising:

a flexible head covering portion having a front side, a back side and a substantially circular lower rim, said back side and said lower rim including a gap formed by first and second sides in said back side and said lower rim;

an adjustment strap having first and second ends, said first and second ends being adapted to be releasably secured to said head covering portion near said first and second sides of said gap respectively, said adjustment strap being fully removable, said head covering portion being adapted to receive said first and second ends of said adjustment strap therein such that said first and second ends are hidden from view in use, said head covering portion and said adjustment strap cooperating to provide an adjustable cap having a tailored outer appearance; and a plurality of graphic displays located on said adjustment strap, anyone of said graphic displays being centerable across said gad in said back side of said head covering portion for selective viewing of said one of said graphic displays by adjusting the position of both of said ends of said adjustment strap relative to said first and second sides of said gap.

2. An adjustable cap comprising:

a flexible head coring portion having a front side, a back side and a substantially circular lower rim, said back side and said lower rim including a gap formed by first and second sides in said back side and said lower rim;

a sweatband affixed to, and having substantially the same length as, said lower rim, said sweatband folded into said head covering portion to form a channel, said head covering portion including a pair of openings formed therein near said gap first and second sides said openings being in communication with said channel;

an adjustment strap having first and second ends, said first and second ends being sized to be received within said openings and said channel, said adjustment strap of a length sufficient to span said gap;

at least one graphic display on said adjustment swap, said graphic display being centerable across said gap in said back side of said head coverting portion by adjusting the position of both of said ends of said adjustment strap relative to said openings in said head covering portion; and one of cloth fastening tape hook material and cloth fastening tape loop material affixed to the outer surface of said head covering portion between said first and second sides of said gap and said channel openings and one of cloth fastening tape loop material and cloth fastening tape hook material, whichever is not affixed to said head covering portion, affixed to the inside surface of said adjustment strap for releasably locking said adjustment strap to said head covering portion, whereby said head covering portion, said channel and said adjustment strap cooperate to provide an adjustable cap having a tailored, fit-to-size outer appearance.

3. An adjustable cap comprising:

a flexible head covering portion having an outer surface, a front side, a back side and a substantially circular lower rim, said back side and said lower rim including a gap formed by first and second sides in said back side and said lower rim;

a sweatband affixed to, and having substantially the same length as, said lower rim, said sweatband folded into said head covering portion to form a channel, said head covering portion including a pair of openings formed therein near said gap first and second sides, said openings in communication with said channel, said head covering portion further including cloth fastening tape hook material affixed to said outer surface between said first and second sides of said gap and said openings in communication with said channel; and an adjustment strap having an inside surface and first and second ends, said first and second ends being sized to be received within said openings and said channel, said adjustment strap of a length sufficient to span said gap, said inside surface having cloth fastening tape loop material affixed thereto for releasable locking engagement with said cloth fastening tape hook material on said outer surface of said head covering portion, whereby said head covering portion, said channel and said adjustment strap cooperate to provide an adjustable cap having a tailored, fit-to-size outer appearance.

4. An adjustable cap comprising:

a flexible head covering portion having an outer surface, a front side, a back side and a substantially circular lower rim, said back side and said lower rim including a gap formed by first and second sides in said back side and said lower rim;

a sweatband affixed to, and having substantially the same length as, said lower rim, said sweatband folded into said head covering portion to form a channel, said head covering portion including a of openings formed therein near said gap first and second sides, said openings in communication with said channel, said head covering portion further including cloth fastening tape loop material affixed to said outer surface between said first and second sides of said gap and said openings in communication with said channel; and an adjustment strap having an inside surface and first and second ends, said first and second ends being sized to be received within said openings and said channel, said adjustment swap of a length sufficient to span said gap, said inside surface having cloth fastening tape hook material affixed thereto for releasable locking engagement with said cloth fastening tape loop material on said outer surface of said head covering portion, whereby said head covering portion, said channel and said adjustment swap cooperate to provide an adjustable cap having a tailored, fit-to-size outer appearance.

5. An adjustable cap comprising:

a flexible head covering portion having a front side, a back side, an outer surface and a substantially circular lower rim, said back side and said lower rim including a gap formed by first and second sides in said back side and said lower rim, said head covering portion further including a pair of slits formed therein near said first and second sides of said gap, said outer surface of said head covering portion having one of cloth fastening tape hook material and cloth fastening tape loop material affixed thereto between said gap and said slits;

a fully removable adjustment strap having first and second ends, said adjustment strap sized to be received within said slits such that said first and second ends are hidden from view in use, the inner surface of said adjustment strap having one of cloth fastening tape loop material and cloth fastening tape hook material, whichever is not affixed to said head covering portion, affixed thereto for securing said adjustment strap to, and adjusting the size of, said head covering portion, said head covering portion and said adjustment strap cooperating to provide an adjustable cap having a tailored outer appearance;

a sweatband having substantially the nine length as said lower rim, said sweatband being affixed to said head coveting portion in a manner which forms a channel in communication with said slits, said channel sized to receive and guide said adjustment strap; and at least one graphic display on said adjustment strap, said graphic display being centerable across said gap in said back side of said head covering portion by adjusting the position of both of said ends of said adjustment strap relative to said first and second sides of said gap.

* * * * *